US005864882A

United States Patent [19]

Kowalyk

[11] Patent Number: 5,864,882

[45] Date of Patent: Feb. 2, 1999

[54] DECORATIVE KNOT COVER

[76] Inventor: Cynthia L. Kowalyk, P.O. Box 6796, Hilton Head Island, S.C. 29926

[21] Appl. No.: 916,214

[22] Filed: Aug. 22, 1997

[51] Int. Cl.[6] ..... A41D 25/02; A41D 27/08

[52] U.S. Cl. ..... 2/148; 2/149; 2/150; 2/152.1; 2/153; 2/244

[58] Field of Search ..... 2/144, 145, 148, 2/149, 150, 152.1, 153, 244, 154, 135, 156, 157

[56] References Cited

U.S. PATENT DOCUMENTS

| | | | |
|---|---|---|---|
| 919,942 | 4/1909 | Person | 2/153 |
| 2,180,861 | 11/1939 | Casidy | 2/153 |
| 2,316,002 | 4/1943 | Koivisto | 2/153 |
| 2,617,108 | 11/1952 | Anzell | 2/153 |
| 2,631,292 | 3/1953 | Cunningham | 2/153 |
| 2,702,905 | 3/1955 | Peake | 2/153 |
| 2,714,719 | 8/1955 | Peake | 2/153 |
| 5,493,731 | 2/1996 | Amnott | 2/153 |

*Primary Examiner*—Jeanette Chapman
*Attorney, Agent, or Firm*—Hunton & Williams

[57] ABSTRACT

A decorative knot cover is adapted to be easily placed over and removed from the knot of a necktie, scarf or other elongated length of material. The decorative knot cover comprises a unitary, rigid structure having a generally triangular-shaped front face with side portions extending therefrom and connected by a back portion, collectively defining an opening through which an elongated length of knotted material may be pushed. A tab on the back upper surface easily fastens the knot cover to the knot. A magnet or other fastening device may be embedded in the front face to receive a removable decorative stone or other object. The knot cover is preferably molded or cast from one piece of solid metal such as gold, silver, bronze, pewter or copper for example.

2 Claims, 1 Drawing Sheet

DECORATIVE KNOT COVER

FIELD OF THE INVENTION

This invention relates to a decorative knot cover for neckties and scarves.

BACKGROUND OF THE INVENTION

Knot covers and knot simulators generally are well known in the art. Knot covers generally refer to structures used to cover a knot formed in a necktie, scarf or other elongated length of material. Knot covers are used primarily for purposes of enhanced appearance. For example, the cover can hide wrinkled cloth or a poorly made knot. Knot simulators generally have open ends at the top through which the ends of a necktie are received to be pulled together at a common opening at the bottom to give the appearance of a knot, without requiring the user to actually tie a knot.

Various drawbacks exist with known knot covers and knot simulators. For example, U.S. Pat. No. 5,010,593 to Stevens, Jr. (Cols. 1–2) acknowledges various shortcomings in existing knot covers and simulators including the difficulty in the placement and removal of a knot cover. According to Stevens, Jr., either a device is easy to put on, but easily falls off, or if it is well secured, the device usually does not cover a knot, but is a substitute for the knot. Among other things, Stevens, Jr. attempts to address these problems by using a knot cover with multiple panels that must be folded and fasteners for fastening various panels. This is complex, appears to be difficult to put on, and requires fasteners for fastening panels together. Other drawbacks exist.

U.S. Pat. No. 5,035,002 to Knight, Jr. refers to a "knot cover" and simulator that does not require the tying of a knot. According to one aspect of this reference, the interior of the device can be covered with a flocking material to increase friction and theoretically retain the device in place. The Knight device is preferably made of plastic, if flexible, and uses friction to retain the device on the tie. Depression 30 and indentation 38 may be used to attach ornamental devices with a tie tac or post type earring. The post may pierce the necktie to function as a retainer. This can cause undesired punctures in the tie material, does not ensure that the tie tac will not fall out, and suffers from various other drawbacks. Other knot covers, simulators and other devices are disclosed in U.S. Pat. No. 4,573,219 to Hooten entitled "Necktie Knot Simulator" dated Mar. 4, 1986; U.S. Pat. No. 4,723,422 to Foster entitled "Necktie Simulating Brooch" dated Feb. 9, 1988; U.S. Pat. No. 4,977,624 to Safford entitled "Tie Knot" dated Dec. 18, 1990; U.S. Pat. No. 5,134,861 to Koven entitled "Neckwear Knot Enhancer" dated Aug. 4, 1992; U.S. Pat. No. 5,216,757 to Dorkin entitled "Knot Simulating Neck Tie Clasp" dated Jun. 8, 1993; U.S. Pat. No. 5,313,810 to Koven entitled "Neckwear Knot Enhancer" dated May 24, 1994; U.S. Pat. No. 5,400,439 to Petroff entitled "Hi-Fashion, Knottless Necktie" dated Mar. 28, 1995; U.S. Pat. No. 5,432,953 to Kim entitled "Neck Tie Structure With A Tie Knot Former" dated Jul. 18, 1995; U.S. Pat. No. 5,461,726 to Wade entitled "Device For Wearing Around The Neck Of A User" dated Oct. 31, 1995; U.S. Pat. No. 5,493,731 to Amnott entitled "Necktie Accessory" dated Feb. 27, 1996 and U.S. Pat. No. 5,600,852 to Densch entitled "Knotless Interchangeable Neckwear" dated Feb. 11, 1997. Various drawbacks exist with these and other prior devices.

SUMMARY OF THE INVENTION

An object of the invention is to overcome these and other drawbacks of known knot covers.

Another object of the invention is to provide an improved decorative knot cover for covering a knot formed in an elongated length of material, such as a necktie or scarf.

Another object of the invention is to provide a decorative knot cover with an improved mechanism for easily and effectively retaining the knot cover on a knot.

Another object of the invention is to provide a decorative knot cover adapted to receive and securely retain a variety of decorative or ornamental objects.

These and other objects of the invention are achieved by forming a knot cover as a rigid, unitary structure generally in the shape of a knot (e.g., an inverted triangular shape) and providing a unitary curved tab that extends from the top of the knot cover downward toward the back of the knot cover. The tab can be attached over a portion of the knot to retain the knot cover on the knot.

According to one embodiment, the knot cover may be formed from a cast or molded metal material with an inverted triangular configuration having side portions connected at the back, and having upper and lower openings to allow the insertion of a knot. This enables a single knot cover to take on different looks. The knot cover may be cast or molded in one piece, preferably from metal such as silver, gold, bronze, pewter, brass, base metal or copper. Other materials such as plastic may be used in some circumstances.

In operation, a user forms a knot from an elongated length of material and inserts a portion of the material through the knot cover and the bottom of the knot cover. The curved tab on the top of the knot cover is hooked over a portion of the knot to assist in retaining the knot cover on the knot.

The face of the knot cover may have a mechanism for receiving and retaining a decorative or ornamental item. The item may be attached to the cover by one or more small magnets or by other attachment mechanisms. This allows the insertion of decorative objects such as gem stones, insignias, logos, etc. to be located on the face of the knot cover.

Decorative colors, designs, or the like, may be incorporated into the knot cover. For example, colors, designs or logos may be painted onto the knot cover. Etching, enameling, engraving or other methods can be used.

DESCRIPTION OF THE PREFERRED EMBODIMENTS

Figure 1:
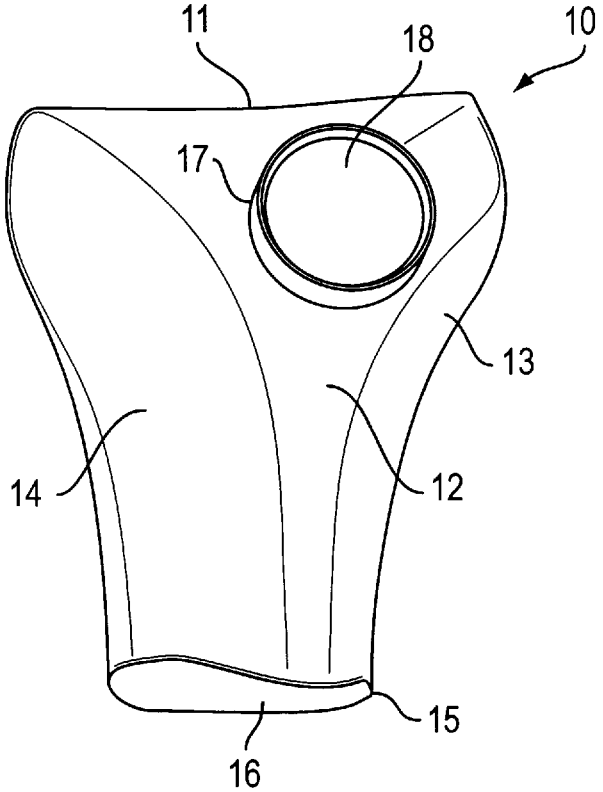
FIG. 1 is a frontal schematic illustration of a knot cover according to one embodiment of the invention.

Referring now to the figures, FIG. 1 schematically illustrates a front view of a knot cover according to one embodiment of the invention. Knot cover 10 preferably has a generally triangular configuration and is defined by a top portion 11, a front portion 12, side portions 13, 14 and bottom portion 15. An opening 16 is formed at the bottom portion 15. Optionally, a decorative item retainer 17 may be formed in a portion of the knot cover 10 (e.g., in the front portion 12) to receive and selectively retain a removable decorative item 18.

Figure 2:
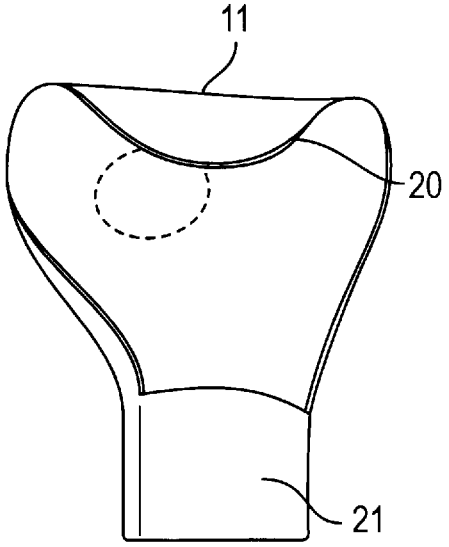
FIG. 2 is a back schematic illustration of a knot cover according to one embodiment of the invention.
Figure 3:
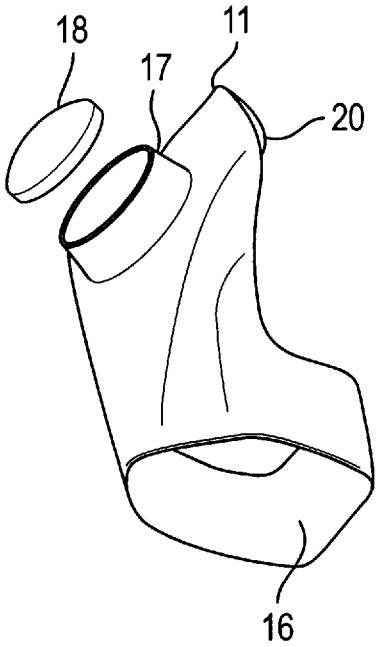
FIG. 3 is a side schematic illustration of a knot cover according to one embodiment of the invention.

FIGS. 2 and 3 illustrate other aspects of the invention. For example, as shown in FIG. 2, a tab 20 extends downwardly from the top portion 11 towards the back of the knot cover. A side schematic view of the tab is illustrated in FIG. 3. As detailed below, the tab 20 easily can be placed over a portion of a knot to assist in holding the knot cover 10 in place. As further illustrated in FIG. 2, a back portion 21 connects the side portions 13 and 14 near the bottom portion 15 and, in part, defines the opening 16.

Figure 4A:
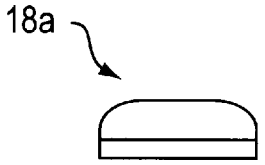
FIGS. 4A and 4B are schematic illustrations of decorative items for use with the knot cover of the present invention.
Figure 4B:
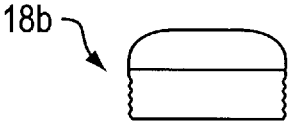

The decorative item retainer 17 is preferably formed in a portion of the knot cover (e.g., a front face thereof) and is adapted to receive and selectively retain a removable decorative item 18. According to one embodiment, the decorative item may comprise a decorative portion 18*a* and a base portion 18*b* (FIGS. 4A, 4B). The decorative portion 18*a* may comprise a gem stone, logo, insignia or other decorative device. The base portion 18*b* is preferably adapted to mate with the retainer 17. For example, according to one embodiment, the base may comprise a metallic material and the retainer may comprise one or more magnets with sufficient strength to securely hold the decorative item 18 in place, yet enable a user to remove the decorative item, if desired. Alternatively, the base portion 18*b* may comprise a magnetic material and the retainer may comprise a metallic material.

As shown schematically in FIG. 4B, the base portion 18*b* may comprise a male threaded portion. According to this embodiment, the retainer 17 would comprise a female threaded portion. Alternatively, the base 18*b* could comprise a female threaded portion and the retainer 17 could comprise a male threaded portion. Various alternative retention techniques can be used. Preferably, however, the technique used should enable the decorative item to easily be located in, securely retained by, and easily removed from, the retainer 17. Other examples of such techniques include a snap-fit, complimentary male/female portions on the decorative item and retainer, one or more locking tabs on the base portion 18*b* that are inserted into one or more slots in the retainer 17, and then rotated to lock the decorative item into the retainer, etc.

Preferably, the knot cover 10 is formed from a cast or molded metal material with an inverted triangular configuration having side portions connected at the back, and having upper and lower openings to allow the insertion of a knot. This enables a single knot cover to take on different looks. The knot cover may be cast or molded in one piece, preferably from metal such as silver, gold, bronze, pewter, brass, base metal or copper. Other materials such as plastic may be used in some circumstances.

In operation, a user forms a knot from an elongated length of material and inserts a portion of the material through the knot cover and the bottom of the knot cover. The curved tab on the top of the knot cover is hooked over a portion of the knot to assist in retaining the knot cover on the knot.

According to one embodiment, the side portions are angled back from the front portion at an approximately 45 degree angle, and connect to each other and the back and bottom of the knot cover. This embodiment may produce a more pleasing look than just a cylinder or hollow tube. However, these and other configurations may also be used.

According to one aspect of the invention, the knot cover is a decorative accessory, but the user must still tie a standard knot. However, a single knot cover can take on different looks. For example, black gem stones attached to a male connector base could be inserted into a magnetic female connector on the knot cover. In addition, depending on the color of the tie and outfit worn, these stones could be easily removed and replaced with diamond stones, for example, attached to a male metal connector and inserted into the female magnetic connector on the knot cover surface. This would create a more formal look without the need for the purchase of another knot cover. The knot cover can also have colors or designs. For example, painting, etching, enameling, dyeing, staining or engraving can be used to decorate the knot cover. Other methods of decorating can be used. The knot cover is unisex, it can be worn by both males and females, and the different insertion stones create many different possible looks.

The disclosure is not an attempt to limit the invention, and is intended to cover all modifications and alternate embodiments falling within the scope of the invention and as defined in the claims.

I claim:

1. A decorative knot cover comprising:

a unitary rigid structure having a front portion, a top portion, side portions and a back portion, said front portion having a generally triangular configuration, said side portions extending from said front portion and being connected by the back portion;

a generally curved tab extending from said top portion toward the back portion, said tab being adapted to secure the knot cover to a portion of a knot;

wherein at least part of said front portion, side portions and back portion define an opening for allowing the insertion of an elongated length of material to pass therethrough; and a decorative item removably attachable to said knot cover, said decorative item comprising a decorative portion and a base, and receiving means formed in said knot cover for receiving said decorative item, wherein said receiving means and base are magnetically attractive to one another.

2. A decorative knot cover comprising:

a unitary rigid structure having a front portion a top portion, side portions and a back portion, said front portion having a generally triangular configuration, said side portions extending from said front portion and being connected by the back portion and wherein at least part of said front portion, side portions and back portion define an opening for allowing the insertion of an elongated length of material to pass therethrough;

a generally curved tab extending from said top portion toward the back portion, said tab being adapted to secure the knot cover to a portion of a knot;

reception means formed in said knot cover for enabling a decorative item to be removably received and retained by said knot cover; and wherein said reception means and decorative item comprise complimentary threaded portions.

* * * * *